US005870789A

United States Patent [19]

Carranza-Aubry

[11] Patent Number: 5,870,789

[45] Date of Patent: Feb. 16, 1999

[54] PRECAST BRIDGES

[76] Inventor: Rene Carranza-Aubry, Av. Nuevo Leon 249, Planta Baja, Hipodromo Condesa, 06100 Mexico City, Mexico

[21] Appl. No.: 937,787

[22] Filed: Sep. 24, 1997

Related U.S. Application Data

[63] Continuation of Ser. No. 564,713, Nov. 29, 1995, abandoned.

[30] Foreign Application Priority Data

Nov. 30, 1994 [MX] Mexico ..... 9409262

[51] Int. Cl.[6] ..... E01D 19/02; E02D 29/02

[52] U.S. Cl. ..... 14/73; 14/74.5; 14/75; 14/77.1; 405/285; 405/286

[58] Field of Search ..... 14/26, 73, 73.5, 14/74.5, 75, 76, 77.1, 77.3; 405/284, 285, 286

[56] References Cited

U.S. PATENT DOCUMENTS

| | | | |
|---|---|---|---|
| 3,953,979 | 5/1976 | Kurose | 405/286 |
| 4,123,485 | 10/1978 | Tang | 14/73 X |
| 4,558,969 | 12/1985 | Fitzsimons | 405/124 |
| 4,655,646 | 4/1987 | Babcock et al. | 405/284 X |
| 4,790,690 | 12/1988 | Vidal et al. | 405/284 X |
| 5,406,663 | 4/1995 | Chen | 14/77.3 X |
| 5,483,716 | 1/1996 | Burnaman | 14/73 |
| 5,549,420 | 8/1996 | Nakayama | 405/286 |

FOREIGN PATENT DOCUMENTS

| | | | |
|---|---|---|---|
| 1742392 | 6/1992 | Russian Federation | 14/74.5 |
| 1744171 | 6/1992 | Russian Federation | 14/74.5 |
| 796301 | 1/1981 | U.S.S.R. | 14/74.5 |

OTHER PUBLICATIONS

Ascent Magazine, "Bridge 'Penuelas, ' Queretaro City, Queretaro State, Mexico", Fall, 1994, Magazine mailed Oct. 20, 1994.

*Primary Examiner*—James Lisehora
*Attorney, Agent, or Firm*—Nikaido, Marmelstein, Murray & Oram LLP

[57] ABSTRACT

Bearing shoes that run under the abutment's axis with cradles whose precast walls are placed over the bearing shoe assembly, so that when the concrete is poured over these bearing shoes, an integral unit of the bearing shoe integrated with the cradle is formed. For the walls, TT (double T) sections are used, which consist of precast elements of reinforced and/or pre-stressed concrete, that are able to resist the horizontal and vertical forces that could act over the bridge's abutments. These TT sections are used as abutments, wings and gravity retaining walls; as central piers, precast elements of columns with caps are used, in which rectangular-section beams are simply supported with their integrated bents. Occasionally, when the vehicles access embankment or earth fills to the bridge allow it, the abutment is anchored in order to avoid its horizontal thrust, as reinforced earth.

2 Claims, 7 Drawing Sheets

PRECAST BRIDGES

This application is a continuation of application Ser. No. 08/564,713 filed Nov. 29, 1995, now abandoned.

The present invention refers to the improvements made to precast bridges that include sub-structure elements such as foundation, central piers and walls, and super-structure elements.

Even though the bridges built up to this day use some precast elements, their use hasn't been optimized nor has the amount of materials been reduced without a decrease on their performance.

OBJECTS AND SUMMARY OF THE INVENTION

It is an object of the present invention to provide a method of building a bridge that could meet these goals which not only reduces the total weight of the structure but also the costs and construction time, with a better appearance.

Thus, one object of this invention is the improvement made to precast bridges that allow the reduction of the total weight of the bridge.

Another object of this invention is to reduce the construction costs.

Yet another object of this invention is to reduce the time needed for its building.

These objects are attained in improvements to the construction of bridges characterized by the use of bearing shoes that run under the abutment's axis with cradles whose precast walls are placed over the bearing shoe assembly, so that when the concrete is poured over these bearing shoes, thereby forming an integral unit of the bearing shoe integrated with the cradle. For the walls, TT (double T) sections are used, which consist of precast elements of reinforced and/or pre-stressed concrete, that are able to resist the horizontal and vertical forces that could act over the bridge's abutments. These TT sections are used as abutments, wings and gravity retaining walls; as central piers, precast elements of columns with caps are used, in which rectangular-section beams are simply supported with their integrated bents. Occasionally, when the vehicles access embankment or earth fills to the bridge allow it, the abutment is anchored in order to avoid its horizontal thrust, as reinforced earth.

BRIEF DESCRIPTION OF THE DRAWINGS

Other objectives and advantages will be made apparent after the following description, the attached drawings and the claims are read.

DETAILED DESCRIPTION OF A PREFERRED EMBODIMENT

Figure 1:
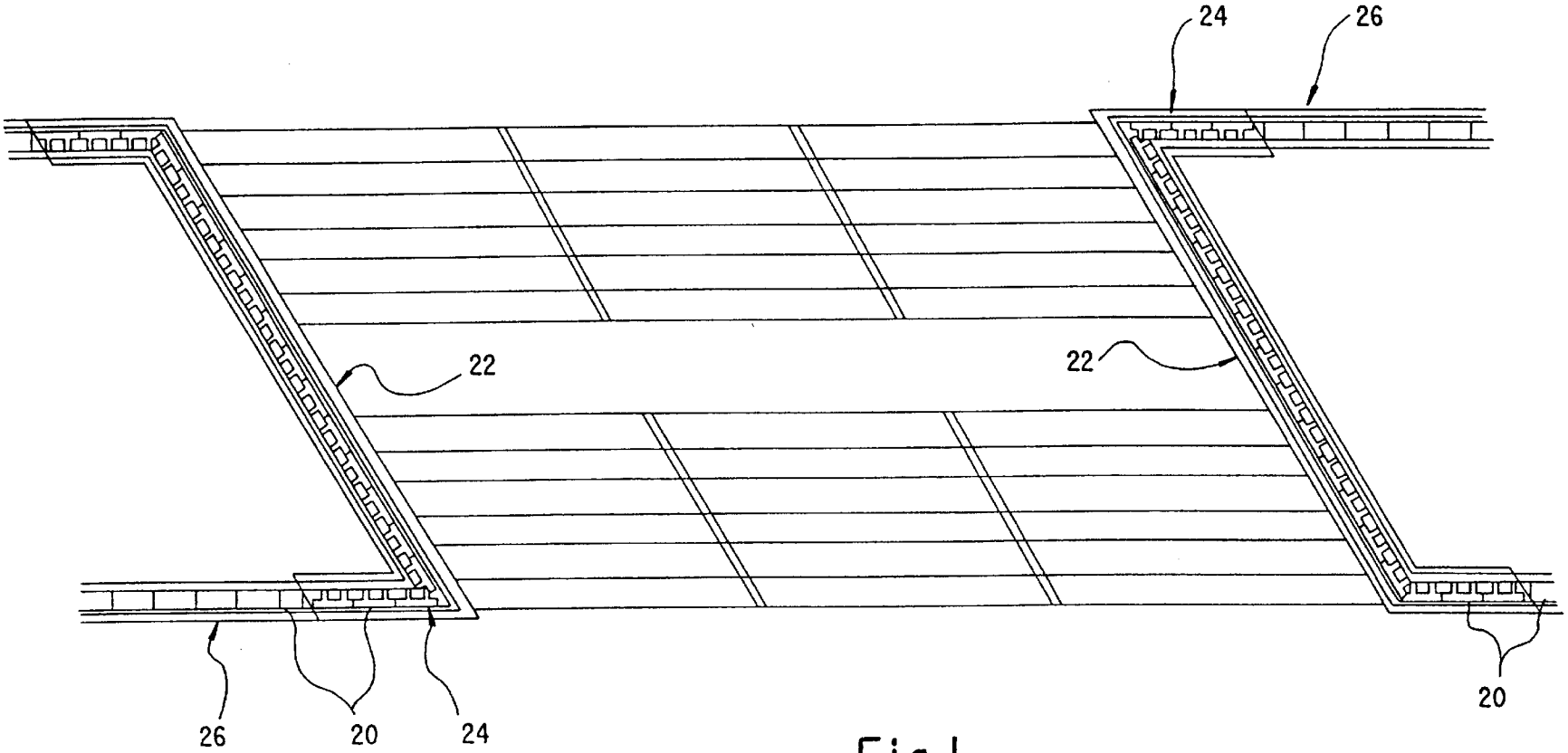
FIG. 1 is a general schematic ground view of the invention.
Figure 2:
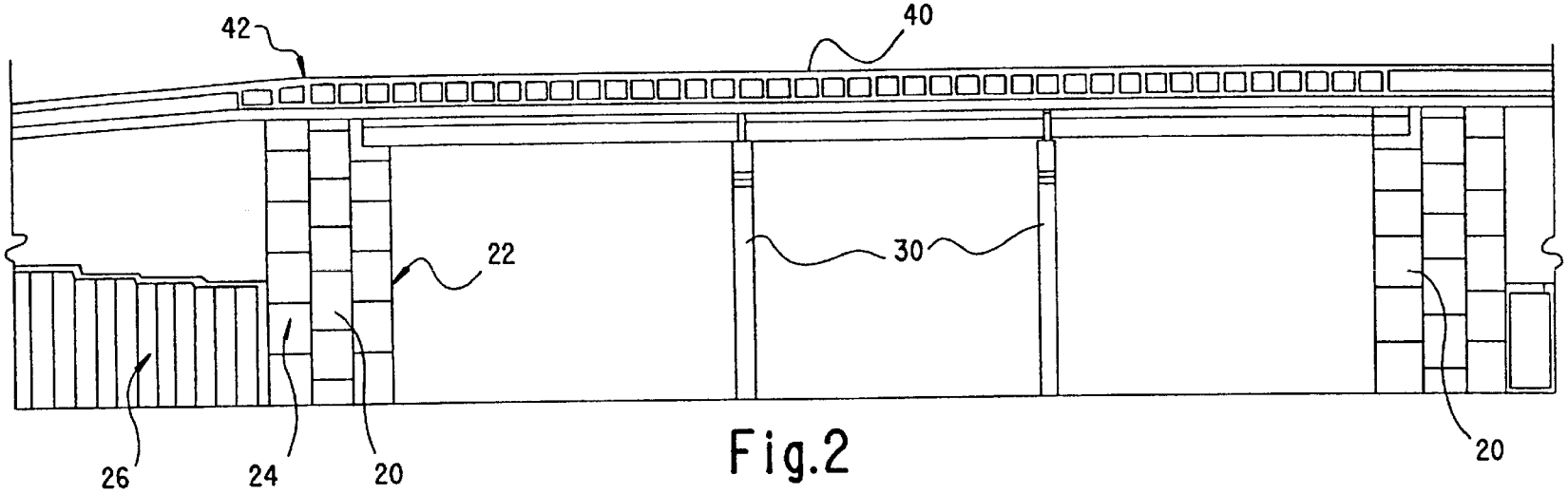
FIG. 2 is a longitudinally elevated view in accordance with the present invention.
Figure 3:
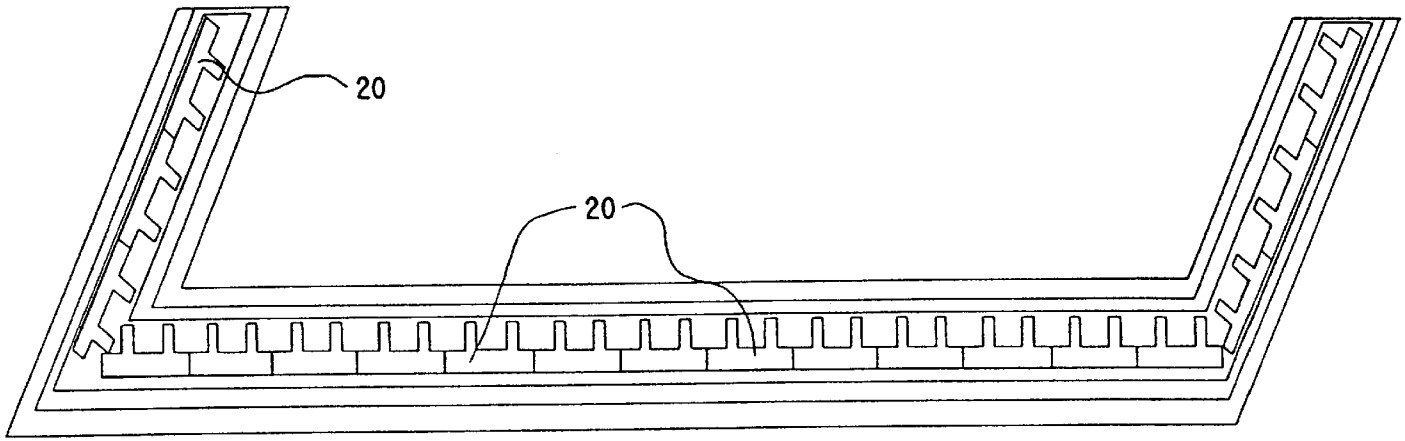
FIG. 3 is a ground view of a typical abutment in accordance with this invention.
Figure 4:
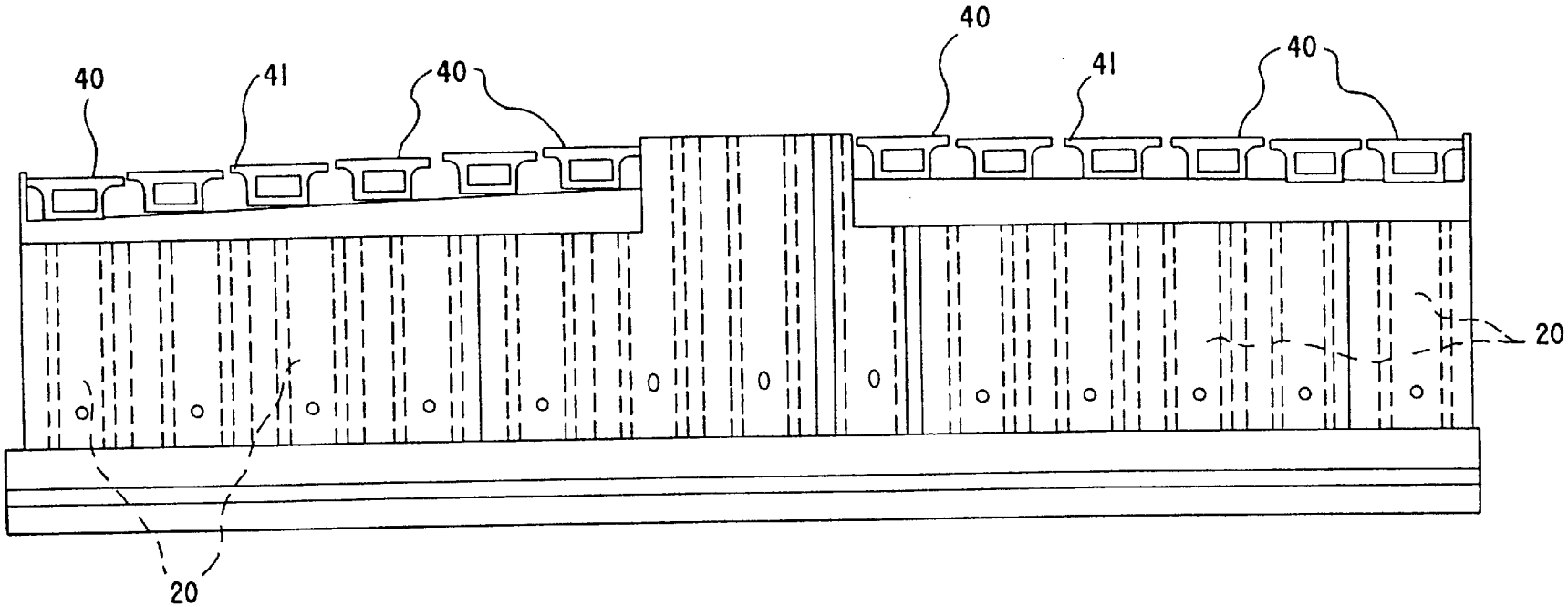
FIG. 4 is an elevated view of as typical abutment in accordance with the present invention.
Figure 5:
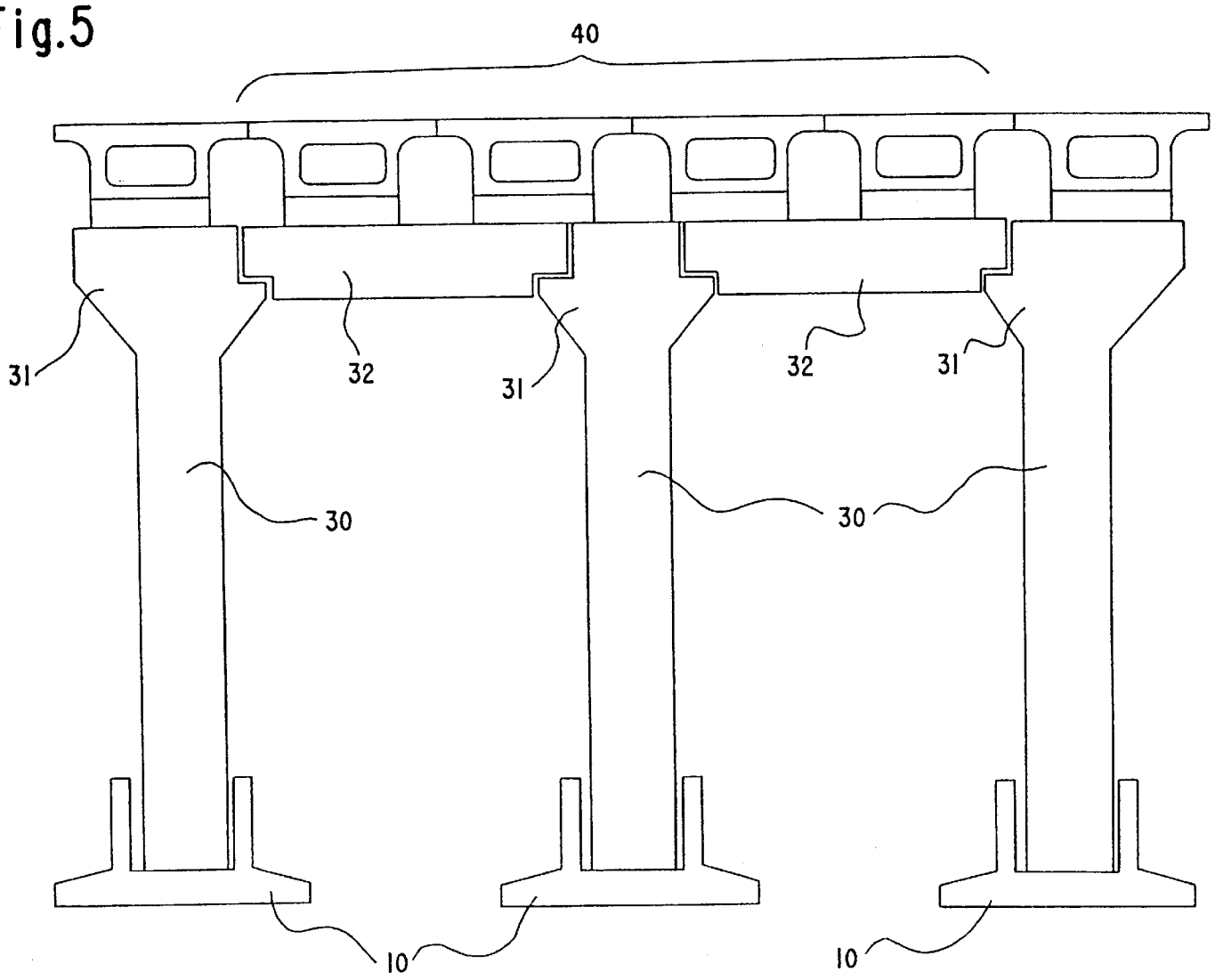
FIG. 5 is a cross sectional view of a pile in accordance with the present invention.
Figure 6:
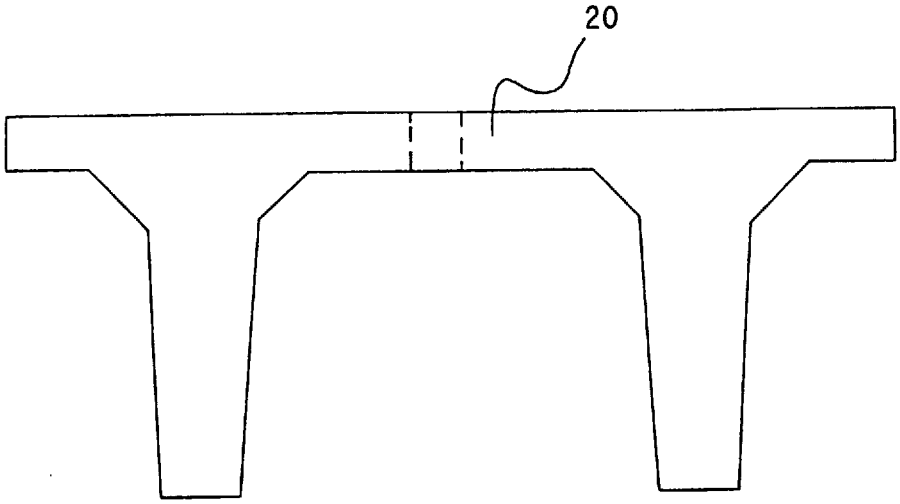
FIG. 6 is a cross sectional view of a TT wall in accordance with the present invention.
Figure 8:
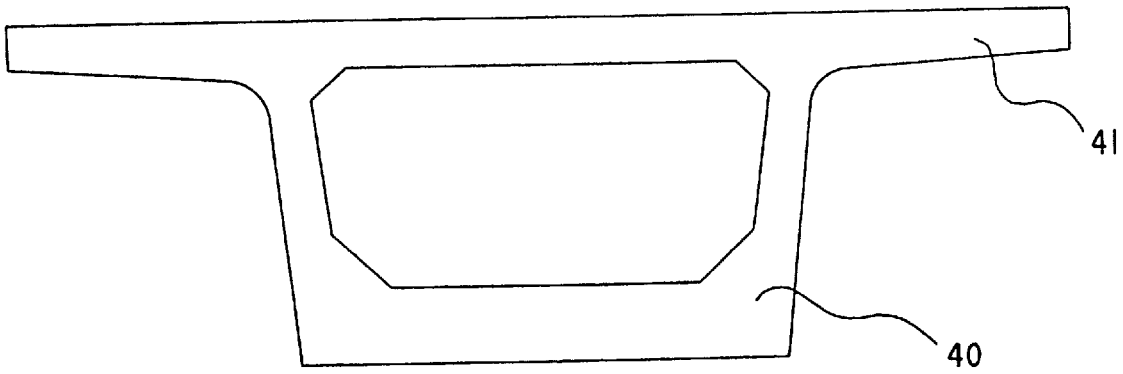
FIG. 8 is a cross sectional view of the beam with wings in accordance with the present invention.
Figure 7A:
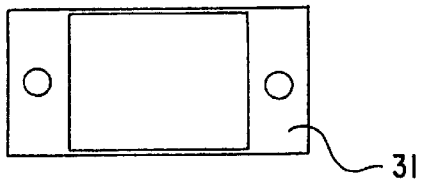
FIGS. 7*a–d* are ground and elevated views respectively of the central and end columns.
Figure 7B:
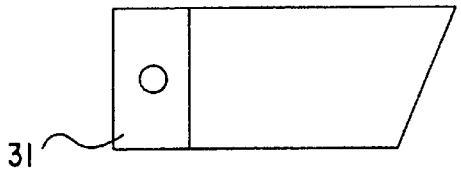
Figure 7C:
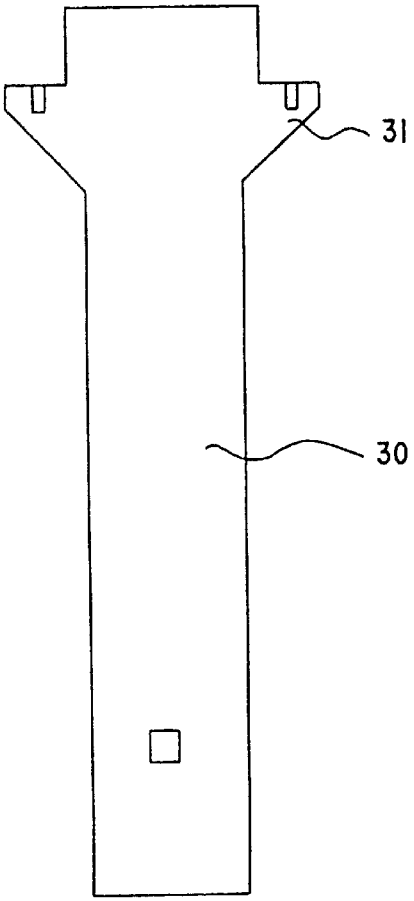
Figure 7D:
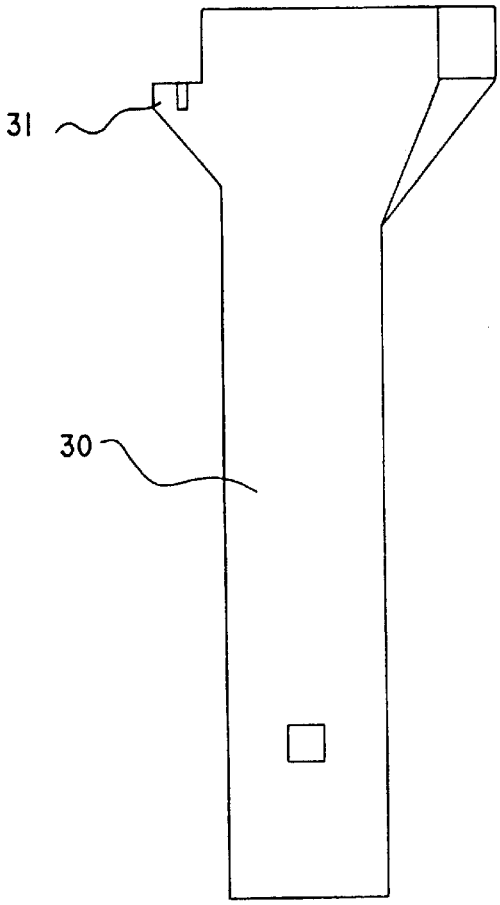

FIGS. 1 through 8 show improvements to precast bridges made of sub-structure elements such as foundations, walls and central piles and of super-structure elements. The improvements are characterized, in terrain not needing deep foundation, (that is from medium to high load capacity) by the use of bearing shoes that run under the abutment's axis with cradles whose precast walls are placed over the bearing shoe's assembly. After this, the concrete is poured over these bearing shoes, forming an integral unit of the bearing shoe with the cradle 10. For the walls, TT sections 20 are used as abutments 22, wings 24 and gravity retaining walls 26.

Figure 9:
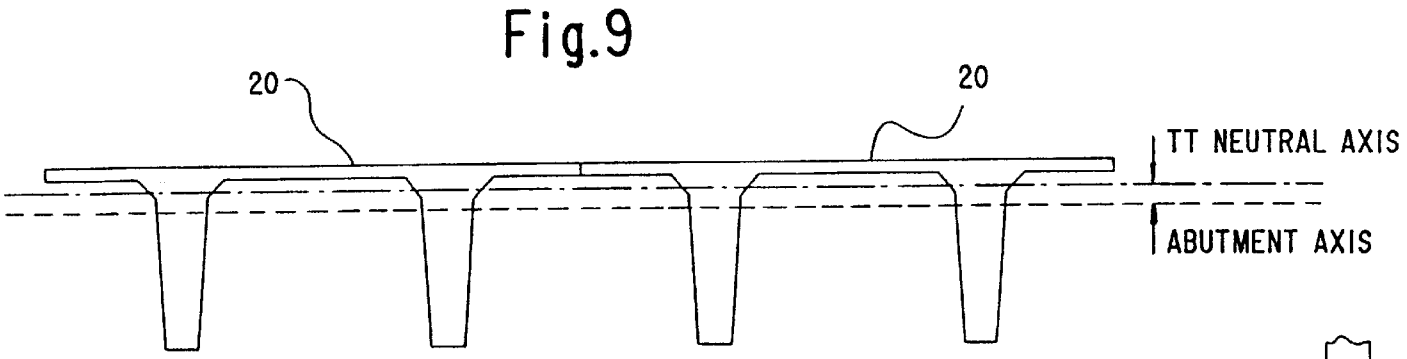
FIG. 9 is a schematic vertical view of a wall abutment showing the abutment axis and the neutral axis.
Figure 10C:
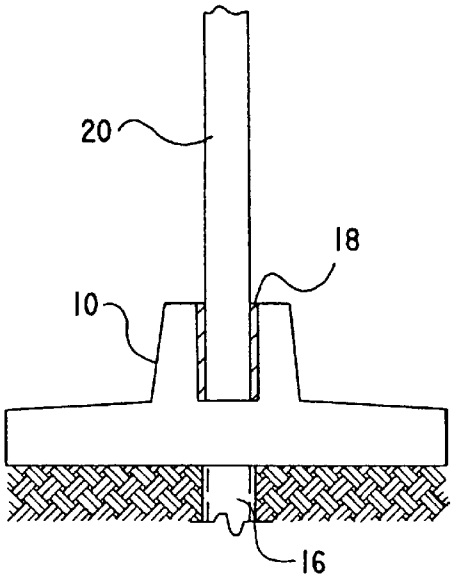
FIGS. 10A, 10B, and 10C are sequential sketches of the steps of forming the TT wall in accordance with the present invention.
Figure 10B:
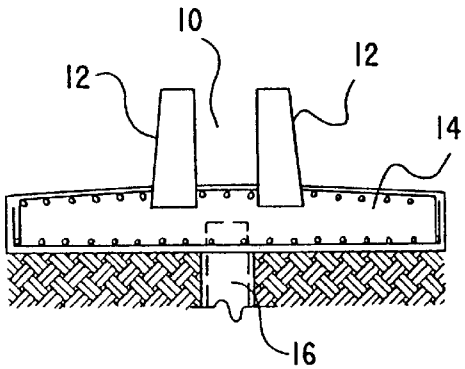
Figure 10A:
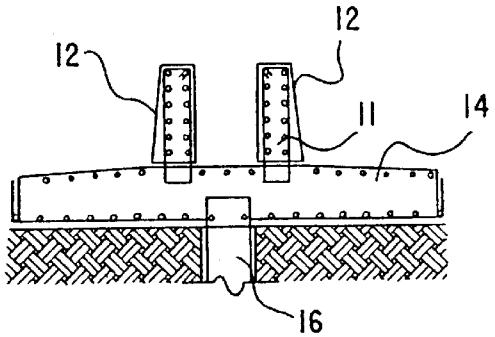

The bearing shoes 14 are formed in place as shown in FIGS. 10A–10C. That is, after any bores for piles 16 are dug, if needed, reinforcing protruding steel 11 is laid in place along the desired position for the shoes 14. Precast cradle walls 12 are positioned as in FIG. 10A to define the uprights. Concrete is poured and formed to make the shoe 14 in situ with the cradle walls 12 as shown in Figure 10B. This makes the cradle 10. Thereafter, the TT sections 20 are placed into the cradles 10 and concrete 18 is poured in place to anchor the TT sections 20. The TT sections and the cradles in the shoes are positioned as shown in FIG. 9 such that the axis of the abutment is at a distance from the neutral axis of the TT section to counteract the bending moment that the earth fill induces to the abutment.

As central supports for the span, precast hollow columns 30 with caps 31 are used, where rectangular-sectioned beams 32 are simply supported with integrated bents, over which box beams 40 with wings 41 are laid; these wings 41 are the surface over which the bearing slab 42 is set. The integrated bents are the steel rods, which connect the column 30 with the principal transverse beams 32 to prevent displacement or movements between the columns and beam yet permit gyre.

In terrain not needing deep foundation, (that is from medium to high load capacity), the use of bearing shoes that run under the abutment's axis with cradles whose precast walls are placed over the bearing shoe's assembly are sufficient.

In terrain needing deep foundation, piles 16 are used as required by soil mechanics in order to increase the charge capacity. These are integrated subsequently by using the bearing shoes that run under the abutments axis with cradles on top whose precast walls are placed over the bearing shoe's assembly. The piles could be typically precast or poured in situ. However, the steel reinforcing rods are left protruding at the top of the piles to be connected with the concrete poured in situ of the bearing shoe. The concrete is poured over these bearing shoes, forming an integral unit of the bearing shoe and pile with the cradle. Thereafter, the necessary TT section, or column is erected and concreted in place.

The walls formed from the TT sections are only connected together in a sense at the bottom thereof where the sections are held in the concrete poured in situ in the cradle after the walls are erected as described above and at the top with the crown beam poured in situ which receives the longitudinal box beams with the flaps. If necessary a lateral retaining wall can be positioned behind the TT sections to contain the earth fill.

While the bridge described so far constitutes the preferred way of implementing this invention, it must be understood that the invention is not limited by this precise way and that some changes can be made without sidetracking the scope of this inventions reach, defined by the claims that follow.

What is claimed is:

1. Precast bridge comprising, in terrain needing deep foundation, (a) abutments, wings, and gravity retaining walls, each abutment, wing, or retaining wall having (1) a longitudinal axis, (2) a bearing shoe aligned along said axis, (3) precast walls placed over the bearing shoe, (4) a cradle formed as an integral unit prepared on site by positioning and assembling said bearing shoe along said axis, placing said precast walls over said bearing shoe, and after this, pouring the concrete over said bearing shoe and said precast walls to form said integral unit, and (5) TT sections of precast elements of reinforced and/or prestressed concrete able to resist the horizontal and vertical forces said TT sections being vertically erected in said cradle and anchored therein by further poured concrete;

(b) central span supports including precast elements of columns and caps on top of said columns;

(c) rectangular section beams supported by integral bents on said caps;

(d) box beams with horizontal wings resting over said rectangular section beams;

(e) bearing slabs laid over a surface of said horizontal wings of said box beams; and (f) piles initially formed and poured prior to preparation of said cradle, said cradle being tied to said piles by protruding steel from the top of the piles prior to the concrete being poured over said bearing shoes and precast walls, thereby forming an integral unit of the cradle and the pile.

2. Precast bridge in accordance with claim 1, wherein said central span supports made of precast elements include hollow columns.

* * * * *